US006978751B2

(12) United States Patent
Rotter et al.

(10) Patent No.: US 6,978,751 B2
(45) Date of Patent: Dec. 27, 2005

(54) CAM FOLLOWER ARM FOR AN INTERNAL COMBUSTION ENGINE

(75) Inventors: Terrence M. Rotter, Sheboygan Falls, WI (US); Theodore E. Wehrman, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/198,789

(22) Filed: Jul. 18, 2002

(65) Prior Publication Data

US 2004/0011312 A1 Jan. 22, 2004

(51) Int. Cl.[7] ..... F01L 1/18

(52) U.S. Cl. ..... 123/90.44; 123/90.16; 123/90.39

(58) Field of Search ..... 123/90.16, 90.27, 123/90.31, 90.39, 90.4, 90.41, 90.44, 90.61, 123/195 C, 198 E, 198 P; 74/559, 569

(56) References Cited

U.S. PATENT DOCUMENTS

| | | | | |
|---|---|---|---|---|
| 1,172,612 A | | 2/1916 | Kremer | |
| 1,301,007 A | | 4/1919 | Roof | |
| 1,410,019 A | | 3/1922 | Krause | |
| 1,469,063 A | | 9/1923 | Wills | |
| 1,524,150 A | * | 1/1925 | Rhoads | 123/90.38 |
| 1,590,073 A | | 6/1926 | Birkigt | |
| 1,684,955 A | | 9/1928 | Goodwin | |
| 2,235,160 A | | 3/1941 | Ljungstrom | |
| 2,459,594 A | | 1/1949 | Smith | |
| 3,118,433 A | | 1/1964 | Lechtenberg | |
| 3,195,526 A | | 7/1965 | Jordan | |
| 3,200,804 A | | 8/1965 | Hensler et al. | |
| 3,314,408 A | | 4/1967 | Fenton | |
| 3,407,741 A | | 10/1968 | Weber et al. | |
| 3,457,804 A | | 7/1969 | Harkness | |
| 3,561,416 A | | 2/1971 | Kiekhaefer | |
| 3,751,080 A | | 8/1973 | Bailey et al. | |
| 3,818,577 A | | 6/1974 | Bailey et al. | |
| 4,030,179 A | | 6/1977 | Schwarz | |
| 4,097,702 A | | 6/1978 | Halsted | |
| 4,134,371 A | * | 1/1979 | Hausknecht | 123/90.43 |
| 4,185,717 A | | 1/1980 | Ford, Jr. et al. | |
| 4,193,310 A | | 3/1980 | Boyer et al. | |
| 4,198,879 A | | 4/1980 | Hornak et al. | |

(Continued)

FOREIGN PATENT DOCUMENTS

DE 3120190 A1 5/1982

(Continued)

OTHER PUBLICATIONS

Matsuda et al., Valve System for Engine, U.S. Appl. No. 2002/0056429 A1, May 16, 2002.*

(Continued)

*Primary Examiner*—Thomas Denion
*Assistant Examiner*—Ching Chang
(74) *Attorney, Agent, or Firm*—Quarles & Brady LLP

(57) ABSTRACT

A valve train in an internal combustion engine, and a method of adjusting the valve timing setting of a valve in such a valve train, are disclosed. In one embodiment, the present invention relates to an engine that includes a crankcase with a cylinder, a valve, a push rod, and a rocker arm supported by the crankcase and coupling the valve to the push rod. The internal combustion engine further includes a cam rotatably supported by the crankcase, and a cam follower arm having first and second ends and, proximate the second end, having bottom and top surfaces. The cam follower arm is rotatably supported by the crankcase about a pivot point proximate the first end. The bottom surface proximate the second end slidingly interfaces the cam, and the top surface proximate the second end interfaces the push rod.

17 Claims, 5 Drawing Sheets

U.S. PATENT DOCUMENTS 4,283,607 A 8/1981 Brightman
4,285,309 A 8/1981 Johansson
4,308,830 A 1/1982 Yamada et al.
4,332,222 A 6/1982 Papez
4,336,777 A 6/1982 Yanagihara et al.
4,366,787 A 1/1983 Gale
4,372,258 A 2/1983 Iwai
4,380,216 A 4/1983 Kandler
4,391,231 A 7/1983 TateBe et al.
4,401,067 A 8/1983 Honda
4,414,934 A 11/1983 Vogl et al.
4,422,348 A 12/1983 Campbell
4,433,651 A 2/1984 Nakakita et al.
4,446,828 A 5/1984 Bauder et al.
4,452,194 A 6/1984 Watanabe
4,458,555 A 7/1984 Holtzberg et al.
4,507,917 A 4/1985 Kandler
4,510,897 A 4/1985 Hatz et al.
4,527,518 A 7/1985 Osaki et al.
4,530,318 A 7/1985 Semple
4,534,241 A 8/1985 Remmerfelt et al.
4,548,253 A 10/1985 Funatani et al.
4,556,025 A * 12/1985 Morita ..... 123/198 F
4,569,109 A 2/1986 Fetouh
4,570,584 A 2/1986 Uetsuji et al.
4,590,905 A 5/1986 Matsuki et al.
4,615,312 A 10/1986 Tsumiyama
4,615,313 A 10/1986 Tsumiyama
4,617,122 A 10/1986 Kruse et al.
4,617,882 A 10/1986 Matsumoto
4,622,933 A 11/1986 Fukuo et al.
4,643,141 A * 2/1987 Bledsoe ..... 123/90.16
4,644,912 A 2/1987 Umeha et al.
4,651,687 A 3/1987 Yamashita et al.
4,656,981 A 4/1987 Murata et al.
4,660,512 A 4/1987 Binder et al.
4,672,930 A 6/1987 Sumi
4,674,455 A 6/1987 Tsuboi
4,684,267 A 8/1987 Fetouh
4,688,446 A 8/1987 Ishikawa
4,691,590 A 9/1987 Geringer et al.
4,696,266 A 9/1987 Harada
4,703,723 A 11/1987 Tamba et al.
4,711,823 A 12/1987 Shiina
4,736,717 A 4/1988 Fujikawa et al.
4,790,271 A 12/1988 Onda
4,793,297 A 12/1988 Fujii et al.
4,802,269 A 2/1989 Mukai et al.
4,805,565 A 2/1989 Sato et al.
4,819,592 A 4/1989 van Ligten
4,819,593 A 4/1989 Bruener et al.
4,822,414 A 4/1989 Yoshikawa et al.
4,828,632 A 5/1989 Adam et al.
4,834,784 A 5/1989 Bidanset
4,836,045 A 6/1989 Lobig
4,838,909 A 6/1989 Bidanset
4,853,179 A 8/1989 Shiina
4,867,806 A 9/1989 Shiina
4,890,583 A * 1/1990 Ohno et al. ..... 123/41.7
4,892,068 A 1/1990 Coughlin
4,898,133 A 2/1990 Bader
4,909,197 A 3/1990 Perr
4,926,814 A 5/1990 Bonde
4,928,550 A 5/1990 Sakai et al.
4,934,442 A 6/1990 Futamura et al.
4,949,687 A 8/1990 Emmersberger
4,958,537 A 9/1990 Diehl et al.
4,964,378 A 10/1990 Tamba et al.
4,986,224 A 1/1991 Zuffi
5,038,727 A 8/1991 Burns et al.
5,057,274 A 10/1991 Futamura et al.
5,065,720 A 11/1991 Nishiyama et al.
5,085,184 A 2/1992 Yamada et al.
5,152,264 A 10/1992 Evans
5,163,341 A 11/1992 Murrish et al.
5,197,422 A 3/1993 Oleksy et al.
5,197,425 A 3/1993 Santi
5,207,120 A 5/1993 Arnold et al.
5,241,873 A 9/1993 Hormann
5,241,932 A * 9/1993 Everts ..... 123/195 R
5,243,878 A 9/1993 Santi
5,265,700 A 11/1993 Santi
5,282,397 A 2/1994 Harkness et al.
5,323,745 A 6/1994 Sato et al.
5,357,917 A 10/1994 Everts
5,370,093 A 12/1994 Hayes
5,375,571 A 12/1994 Diehl et al.
5,421,297 A 6/1995 Tamba et al.
5,463,809 A 11/1995 Hoffman et al.
5,497,735 A 3/1996 Kern et al.
5,555,776 A 9/1996 Gazza
5,555,860 A * 9/1996 Wride ..... 123/90.16
5,556,441 A 9/1996 Courtwright et al.
5,560,333 A 10/1996 Genouille
5,615,586 A 4/1997 Phillips et al.
5,651,336 A 7/1997 Rygiel et al.
5,653,199 A 8/1997 Ishiuchi et al.
5,711,264 A 1/1998 Jezek et al.
5,722,295 A 3/1998 Sakai et al.
5,809,958 A 9/1998 Gracyalny
5,823,153 A 10/1998 Santi et al.
5,863,424 A 1/1999 Lee
5,887,678 A 3/1999 Lavender
5,904,124 A 5/1999 Poehlman et al.
5,943,992 A 8/1999 Kojima et al.
5,964,198 A 10/1999 Wu
5,970,934 A * 10/1999 Vallejos ..... 123/90.44
5,979,392 A 11/1999 Moorman et al.
5,988,135 A 11/1999 Moorman et al.
6,006,721 A 12/1999 Shannon et al.
6,047,667 A 4/2000 Leppanen et al.
6,055,952 A 5/2000 Gau
6,076,426 A 6/2000 Genouille
6,109,230 A 8/2000 Watanabe et al.
6,116,205 A 9/2000 Troxler et al.
6,126,499 A 10/2000 Katayama et al.
6,170,449 B1 1/2001 Saiki et al.
6,213,081 B1 4/2001 Ryu et al.
6,250,271 B1 6/2001 Ikuma et al.
6,269,786 B1 8/2001 Snyder et al.
6,293,981 B1 9/2001 Holderle et al.
6,305,242 B1 10/2001 Smith et al.
6,349,688 B1 * 2/2002 Gracyalny et al. ..... 123/90.39
6,395,049 B2 5/2002 Knodler et al.
6,543,403 B2 4/2003 Kawamoto
6,739,304 B2 * 5/2004 Reinbold et al. ..... 123/193.5

FOREIGN PATENT DOCUMENTS

GB 355365 8/1931
GB 378216 8/1932
WO WO 86/04122 A1 7/1986
WO WO 00/43655 A1 7/2000

OTHER PUBLICATIONS

"Technical Innovations-Briggs & Stratton extends engine life", SAE Off-Highway Engineering, Oct. 2001, p. 4.
3 undated photographs of Briggs & Stratton balance system, admitted prior art.
Marketing literature concerning Briggs & Stratton AVS system, 2001 (2 pages).

Notes and photographs concerning Balance System of Briggs & Stratton shown at Louisville trade show in Jul., 2001 (3 pages of notes, 2 pages of photographs).
Information concerning gerators, obtained at www.vianenterprises.com, printed Mar. 2, 2002 (4 pages).
Information concerning crescent pumps, obtained at www.animatedsoftware.com, printed Jul. 2, 2001 (1 page).
"Gerator Lubricating Oil Pump for IC Engines", S. Manco et al., SAE Intn'l FL98 (San Francisco) (17 pages).
Undated photographs of Kohler Command-Single Automatic Compression Release mechanism, admitted prior (1 page).
Undated photographs of Briggs & Stratton Automatic Compression Release mechanism, admitted prior (1 page).
Undated photographs of Honda OHC Automatic Compression Release mechansim and cam follower, admitted prior art (3 pages).

* cited by examiner

CAM FOLLOWER ARM FOR AN INTERNAL COMBUSTION ENGINE

CROSS-REFERENCE TO RELATED APPLICATIONS

This application is based on U.S. patent application Ser. No. 10/035,101 filed Dec. 28, 2001 and entitled "Balance System for Single Cylinder Engine", which is incorporated by reference herein.

FIELD OF THE INVENTION

The present invention relates to internal combustion engines. In particular, the present invention relates to engine valve trains that employ cam followers.

BACKGROUND OF THE INVENTION

Internal combustion engines commonly employ valves that govern the providing of air and fuel to the engine cylinders and the expulsion of exhaust from the engine cylinders, among other functions. Such valves are often actuated by way of valve trains that interact with cams, which are driven by the crankshaft of the engine as gears on the crankshaft drive complementary gears associated with the cams. Tappet-followers, hydraulic lifters, or other lifter-type mechanisms that interface the cams move substantially linearly toward and away from the cams as the cams rotate. In many such engines, push rods in turn couple these lifter-type mechanisms to rocker arms, which themselves are coupled to the valves. Consequently, the rotation of the cams is translated into linear motion by which the valves are opened and closed.

Depending upon the engine and operational circumstances, the valves of an engine should be opened and closed at different times. The exact valve timing settings that are appropriate for a given engine can vary depending upon a variety of factors including engine design characteristics and intended operational circumstances. With respect to some engines, it would be also desirable if the timing settings for the valves could be individually tailored for different engines during the manufacture of those engines. This would particularly be the case if the different engines were to be used in different operational circumstances. Further, in some engines, it would be desirable if the valve timing settings could be varied during operation of the engine, in response to changing operational circumstances.

Although it would be desirable if the valve timing settings of engines could be varied in these manners, internal combustion engines having the above-described design commonly are limited in terms of the manners in which and extent to which their valve timing settings can be varied. To begin with, it is usually not possible to vary the valve timing settings on an engine in the field, after its manufacture, during the engine's operation. Further, even during the manufacture of the engine (assuming engine components are not redesigned), variation of the valve timing settings is typically only possible by adjusting the angular positioning of the cams with respect to the crankshaft. This typically is achieved by changing the relative orientation of the gears that are associated with the cams with respect to the complementary gears on the crankshaft. However, because each of the teeth of the gears associated with the cams occupies a relatively significant sector on the respective gear, only relatively gross valve timing adjustments can be made in this manner. Thus, the ability to adjust the valve timing settings on internal combustion engines of the above-described design is significantly limited.

Besides being limited with respect to valve timing adjustments, internal combustion engines having the above-described valve trains have additional limitations. In particular, although lifter-type mechanisms such as tappet-followers make it possible to translate rotational movement of the cams into linear motion, the use of such mechanisms has certain drawbacks. The tappet-followers or other lifter-type mechanisms typically must have relatively wide faces that interface the cams, so that the lifter-type mechanisms are guaranteed to remain in contact with the nearest edges of the cams as the cams rotate. The faces on such lifter-type mechanisms tend to wear down over time. Further, in order to guarantee that the lifter-type mechanisms remain in contact with the cams rather than slide off of the cams, the lifter-type mechanisms are further prevented from moving, in directions other than toward and away from the cams, by being positioned within precise bores in the crankcase. Such precise bores can be expensive to manufacture.

It would therefore be advantageous if an internal combustion engine could be developed with an improved valve train design such that modifications to the valve timing settings could be more easily made. Further, it would be advantageous if the improved valve train design made it possible to make fine adjustments to the valve timing settings, rather than simply gross adjustments to those settings. Additionally, it would be advantageous if the improved valve train design alleviated the problems associated with maintaining the proper positioning of tappet-followers or other lifter-type mechanisms relative to the cams interfaced by those mechanisms.

SUMMARY OF THE INVENTION

The present inventors have discovered an improved valve train for an internal combustion engine, where the valve train employs a cam follower arm with a curved flange (a "shoe") at one end. The convex side of the shoe rides along the cam and the concave side of the shoe interfaces the push rod of the valve train. Because of the concave shape of the side of the shoe interfacing the push rod, as well as (in some embodiments) a dimple along the concave side designed to receive the push rod, the push rod remains in contact with the shoe despite the movements of the cam follower arm in response to the rotation of the cam. Thus, a tappet-follower with a large face or other similar lifter-type mechanism is not required in order for the push rod to maintain contact with the cam. Further, by varying the pivot point at which the cam follower arm is attached to, and rotates with respect to, the crankcase, the timing of the movements of the cam follower arm are varied with respect to the rotation of the cam (and the crankshaft). Consequently, fine variations of the cam follower arm's position also produce corresponding fine changes in the valve timing of the engine.

In particular, the present invention relates to an internal combustion engine. The internal combustion engine includes a crankcase with a cylinder, a first valve, a first push rod, and a first rocker arm supported by the crankcase and coupling the first valve to the first push rod. The internal combustion engine further includes a first cam rotatably supported by the crankcase, and a first cam follower arm having first and second ends and, proximate the second end, having bottom and top surfaces. The first cam follower arm is rotatably supported by the crankcase about a first pivot point proximate the first end. The bottom surface proximate the second end slidingly interfaces the first cam, and the top surface proximate the second end interfaces the first push rod.

The present invention further relates to a valve train of an internal combustion engine. The valve train includes a first cam, a first push rod, a first valve, a first rocker arm coupling the first valve to the first push rod, and means for interfacing the first cam and the first push rod and correlating motion of the first cam and the first push rod.

The present invention additionally relates to a method of setting a timing of operation of a first valve in an internal combustion engine. The method includes providing a first cam on the internal combustion engine, providing a first cam follower arm, and selecting a first pivot point about which the first cam follower arm will rotate, where the first pivot point is selected from among at least two different possible pivot points. The method further includes coupling the first cam follower arm onto the internal combustion engine so that the cam follower arm is rotatable about the first pivot point, providing a first push rod that interfaces the first cam follower arm, which in turn slidingly interfaces the first cam, and providing a first rocker arm to couple the first push rod to the first valve. By selecting the first pivot point, the timing of operation of the first valve is set to a desired setting.

DETAILED DESCRIPTION OF THE PREFERRED EMBODIMENT

Figure 1:
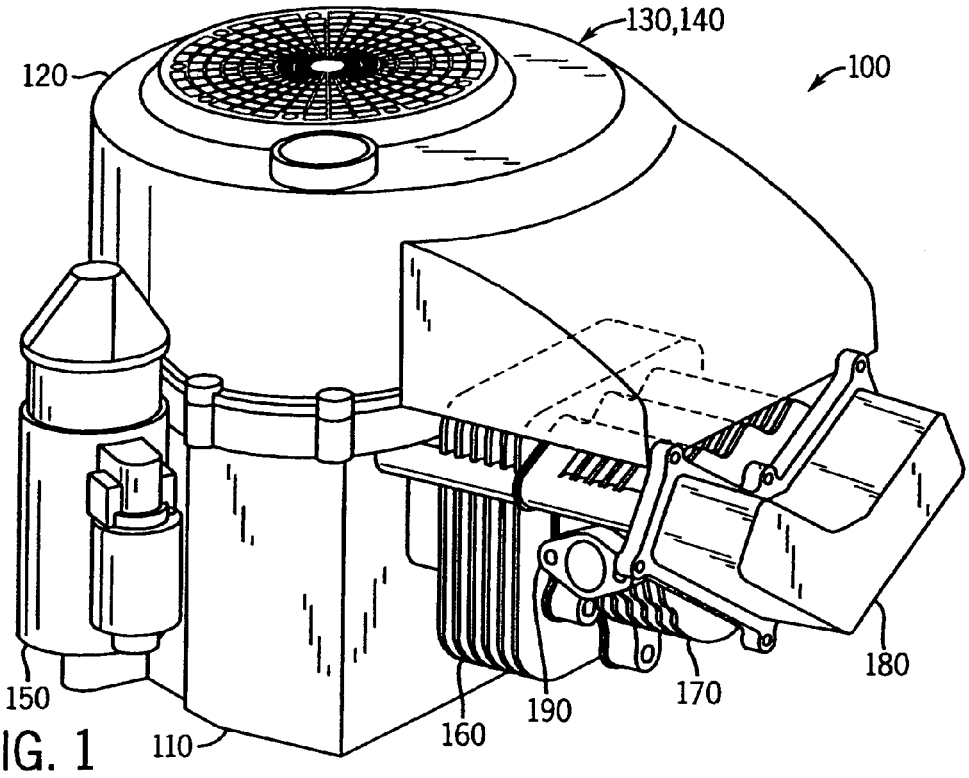
FIG. 1 is a first perspective view of a single cylinder engine, taken from a side of the engine on which are located a starter and cylinder head.
Figure 2:
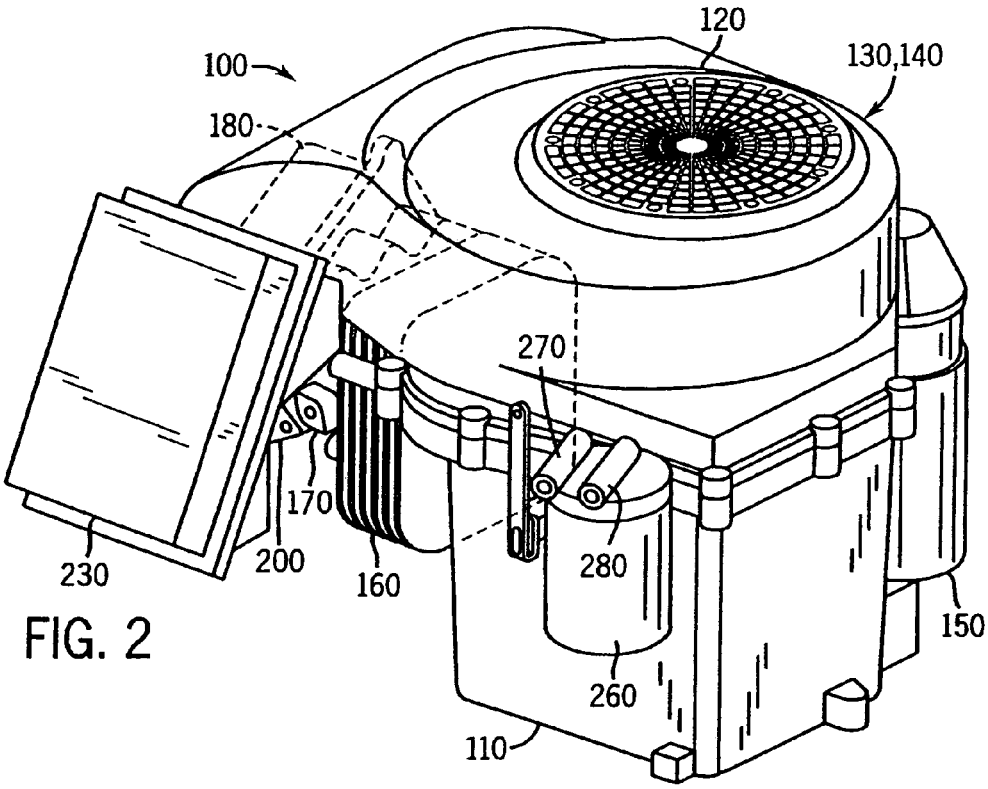
FIG. 2 is a second perspective view of the single cylinder engine of FIG. 1, taken from a side of the engine on which are located an air cleaner and oil filter.

Referring to FIGS. 1 and 2, a new single cylinder, 4-stroke, internal combustion engine 100 designed by Kohler Co. of Kohler, Wis. includes a crankcase 110 and a blower housing 120, inside of which are a fan 130 and a flywheel 140. The engine 100 further includes a starter 150, a cylinder 160, a cylinder head 170, and a rocker arm cover 180. Attached to the cylinder head 170 are an air exhaust port 190 shown in FIG. 1 and an air intake port 200 shown in FIG. 2. As is well known in the art, during operation of the engine 100, a piston 210 (see FIG. 7) moves back and forth within the cylinder 160 towards and away from the cylinder head 170. The movement of the piston 210 in turn causes rotation of a crankshaft 220 (see FIG. 7), as well as rotation of the fan 130 and the flywheel 140, which are coupled to the crankshaft. The rotation of the fan 130 cools the engine, and the rotation of the flywheel 140, causes a relatively constant rotational momentum to be maintained.

Referring specifically to FIG. 2, the engine 100 further includes an air filter 230 coupled to the air intake port 200, which filters the air required by the engine prior to the providing of the air to the cylinder head 170. The air provided to the air intake port 200 is communicated into the cylinder 160 by way of the cylinder head 170, and exits the engine by flowing from the cylinder through the cylinder head and then out of the air exhaust port 190. The inflow and outflow of air into and out of the cylinder 160 by way of the cylinder head 170 is governed by an input valve 240 and an output valve 250, respectively (see FIG. 8). Also as shown in FIG. 2, the engine 100 includes an oil filter 260 through which the oil of the engine 100 is passed and filtered. Specifically, the oil filter 260 is coupled to the crankcase 110 by way of incoming and outgoing lines 270, 280, respectively, whereby pressurized oil is provided into the oil filter and then is returned from the oil filter to the crankcase.

Figure 3:
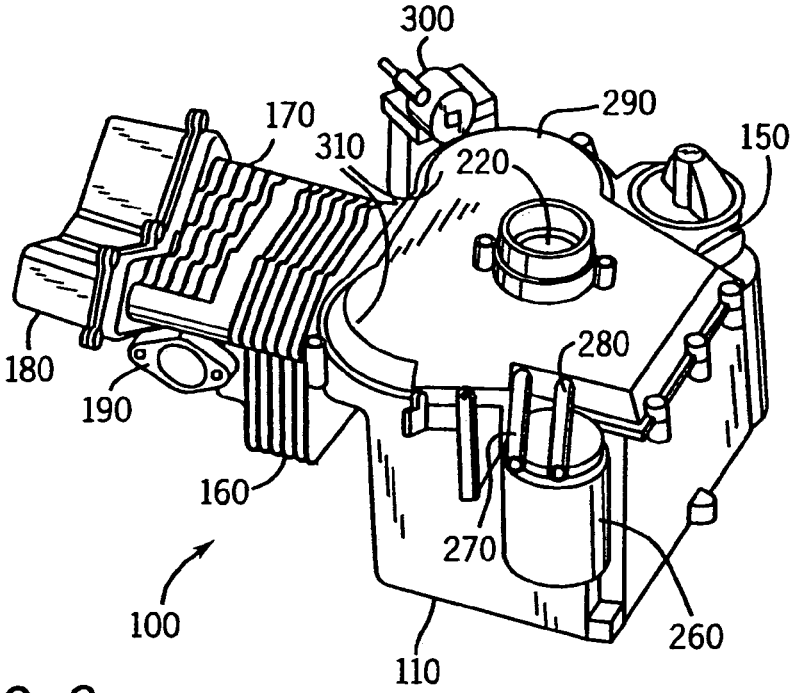
FIG. 3 is a third perspective view of the single cylinder engine of FIG. 1, in which certain parts of the engine have been removed to reveal additional internal parts of the engine.
Figure 4:
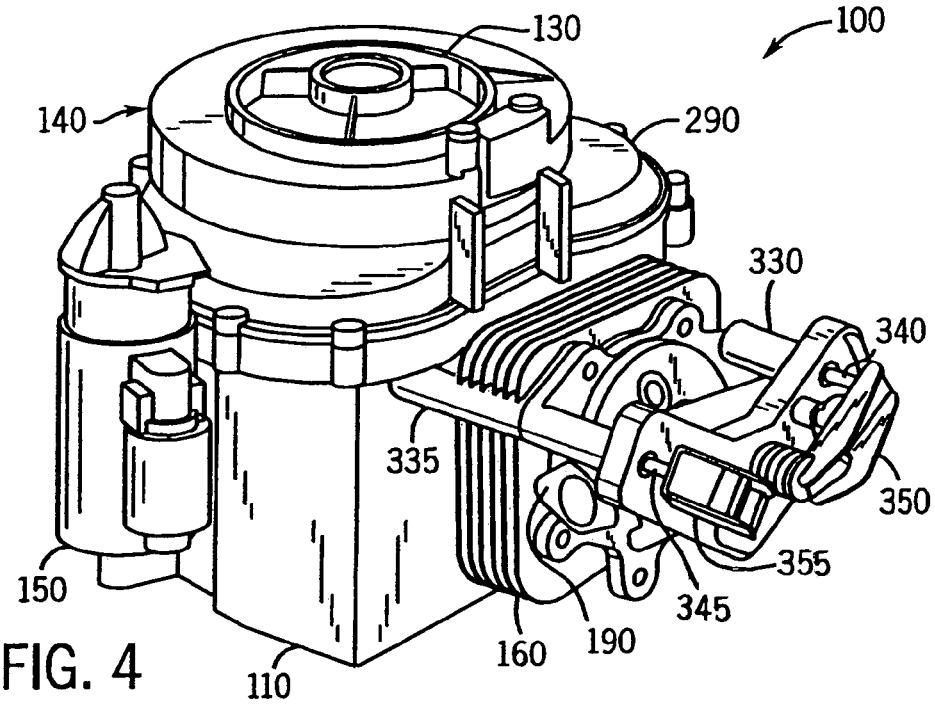
FIG. 4 is a fourth perspective view of the single cylinder engine of FIG. 1, in which certain parts of the engine have been removed to reveal additional internal parts of the engine.

Referring to FIGS. 3 and 4, the engine 100 is shown with the blower housing 120 removed to expose a top 290 of the crankcase 110. With respect to FIG. 3, in which both the fan 130 and the flywheel 140 are also removed, a coil 300 is shown that generates an electric current based upon rotation of the fan 130 and/or the flywheel 140, which together operate as a magneto. Additionally, the top 290 of the crankcase 110 is shown to have a pair of lobes 310 that cover a pair of gears 320, 325 (see FIGS. 5 and 7–8). With respect to FIG. 4, the fan 130 and the flywheel 140 are shown above the top 290 of the crankcase 110. Additionally, FIG. 4 shows the engine 100 without the cylinder head 170 and without the rocker arm cover 180, to more clearly reveal a pair of tubes 330, 335 through which extend a pair of respective push rods 340,345. The push rods 340,345 extend between a pair of respective rocker arms 350,355 and a pair of cams 360, 365 (see FIG. 8) within the crankcase 110, as discussed further below.

Figure 5:
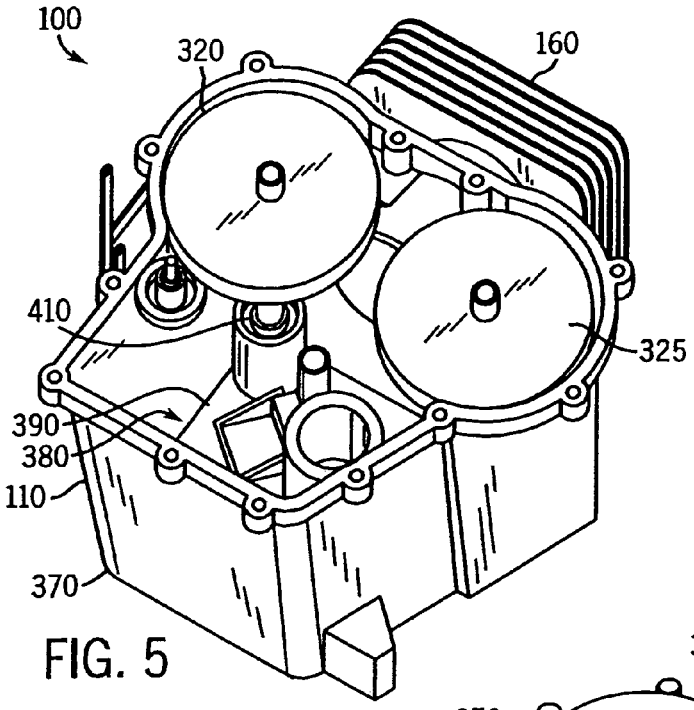
FIG. 5 is fifth perspective view of portions of the single cylinder engine of FIG. 1, in which a top of the crankcase has been removed to reveal an interior of the crankcase.
Figure 6:
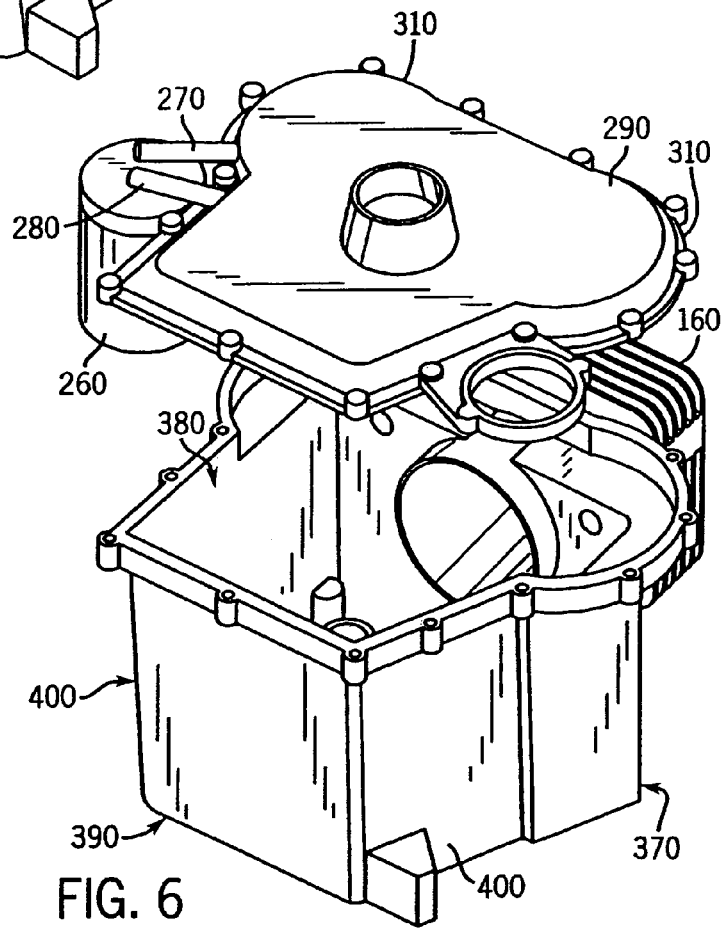
FIG. 6 is a sixth perspective view of portions of the single cylinder engine of FIG. 1, in which the top of the crankcase is shown exploded from the bottom of the crankcase.

Turning to FIGS. 5 and 6, the engine 100 is shown with the top 290 of the crankcase 110 removed from a bottom 370 of the crankcase 110 to reveal an interior 380 of the crankcase. Additionally in FIGS. 5 and 6, the engine 100 is shown in cut-away to exclude portions of the engine that extend beyond the cylinder 160 such as the cylinder head 170. With respect to FIG. 6, the top 290 of the crankcase 110 is shown above the bottom 370 of the crankcase in an exploded view. In this embodiment, the bottom 370 includes not only a floor 390 of the crankcase, but also all six side walls 400 of the crankcase, while the top 290 only acts as the roof of the crankcase. The top 290 and bottom 370 are manufactured as two separate pieces such that, in order to open the crankcase 110, one physically removes the top from the bottom. Also, as shown in FIG. 5, the pair of gears 320, 325 within the crankcase 110 are supported by and rotate upon respective shafts 410,415 (see also FIG. 8) which in turn are supported by the bottom 370 of the crankcase 110.

Figure 7:
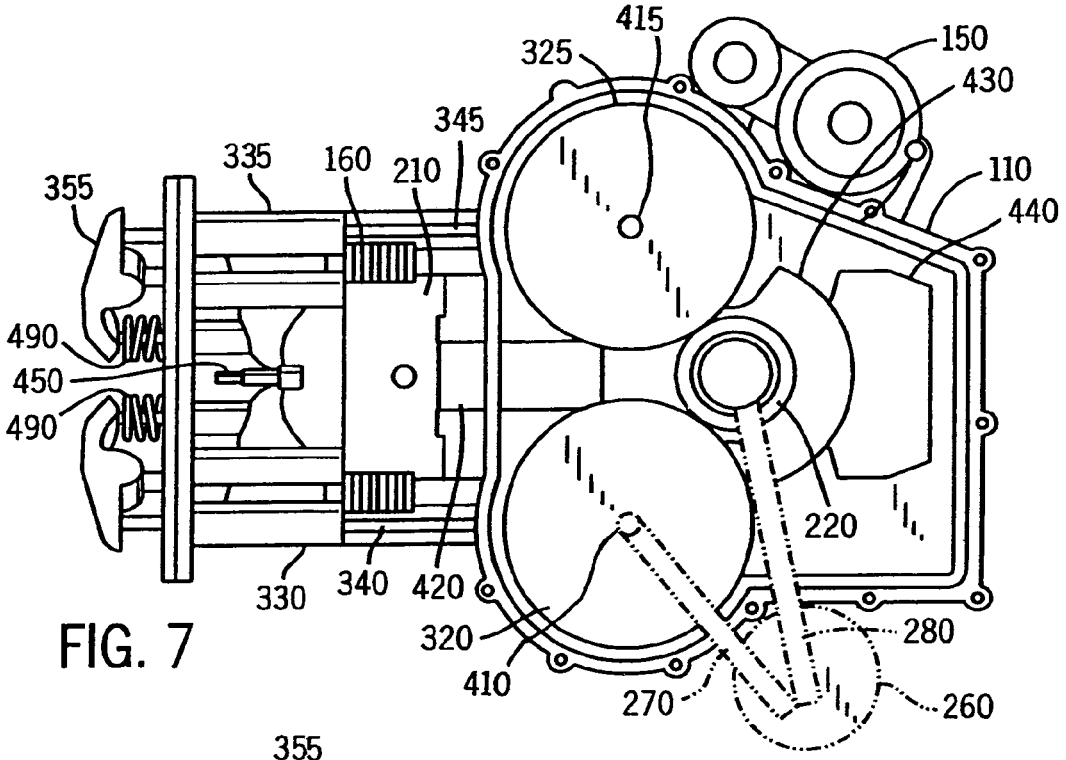
FIG. 7 is a top view of the single cylinder engine of FIG. 1, showing internal components of the engine in grayscale.

Referring to FIG. 7, a top view of the engine 100 is provided in which additional internal components of the engine are shown. In particular, FIG. 7 shows the piston 210 within the cylinder 160 to be coupled to the crankshaft 220 by a connecting rod 420. The crankshaft 220 is in turn coupled to a rotating counterweight 430 and reciprocal weights 440, which balance the forces exerted upon the crankshaft 220 by the piston 210. A gear on the crankshaft 220 further is in contact with each of the gears 320,325, and thus the crankshaft communicates rotational motion to the cams 360,365. In the present embodiment, the shafts 410, 415 upon which the gears 320,325 and cams 360,365 are supported are capable of communicating oil from the floor 390 of the crankcase 110 (see FIG. 5) upward to the gears 320,325. The incoming line 270 to the oil filter 260 is coupled to the shaft 410 to receive oil, while the outgoing line 280 from the oil filter is coupled to the crankshaft 220 to provide lubrication thereto. FIG. 7 further shows a spark plug 450 located on the cylinder head 170, which provides sparks during power strokes of the engine to cause combustion to occur within the cylinder 160. The electrical energy for the spark plug 450 is provided by the coil 300 (see FIG. 3).

Figure 8:
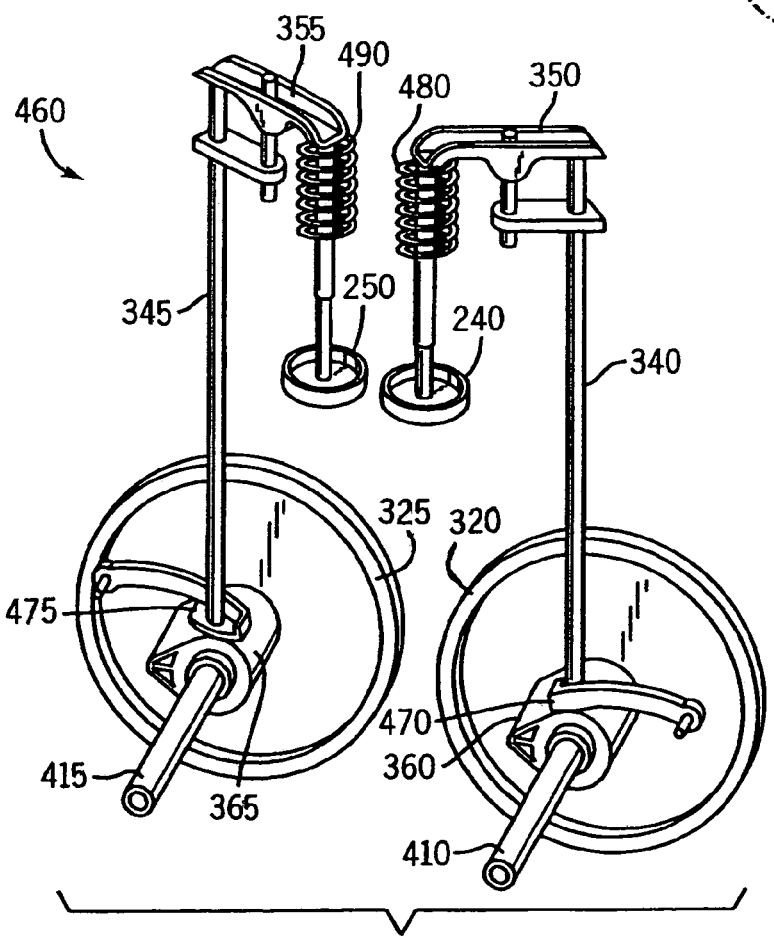
FIG. 8 is a perspective view of components of a valve train of the single cylinder engine of FIG. 1.

Further referring to FIG. 7, and additionally to FIG. 8, elements of a valve train 460 of the engine 100 are shown. The valve train 460 includes the gears 320,325 resting upon the shafts 410,415 and also includes the cams 360,365 underneath the gears, respectively. Additionally, respective cam follower arms 470,475 that are rotatably mounted to the crankcase 110 extend to rest upon the respective cams 360,365. The respective push rods 340,345 in turn rest upon the respective cam follower arms 470,475. As the cams 360,365 rotate, the push rods 340,345 are temporarily forced outward away from the crankcase 110 by the cam follower arms 470,475, which slidingly interface the rotating cams. This causes the rocker arms 350,355 to rock or rotate, and consequently causes the respective valves 240 and 250 to open toward the crankcase 110. As the cams 360,365 continue to rotate, however, the push rods 340,345 are allowed by the cam follower arms 470,475 to return inward to their original positions. A pair of springs 480,490 positioned between the cylinder head 170 and the rocker arms 350,355 provide force tending to rock the rocker arms in directions tending to close the valves 240,250, respectively. Further as a result of this forcing action of the springs 480,490 upon the rocker arms 350,355, the push rods 340,345 are forced back to their original positions.

In the present embodiment, the engine 100 is a vertical shaft engine capable of outputting 15–20 horsepower for implementation in a variety of consumer lawn and garden machinery such as lawn mowers. In alternate embodiments, the engine 100 can also be implemented as a horizontal shaft engine, be designed to output greater or lesser amounts of power, and/or be implemented in a variety of other types of machines, e.g., snow-blowers. Further, in alternate embodiments, the particular arrangement of parts within the engine 100 can vary from those shown and discussed above. For example, in one alternate embodiment, the cams 360,365 could be located above the gears 320,325 rather than underneath the gears.

Figure 9:
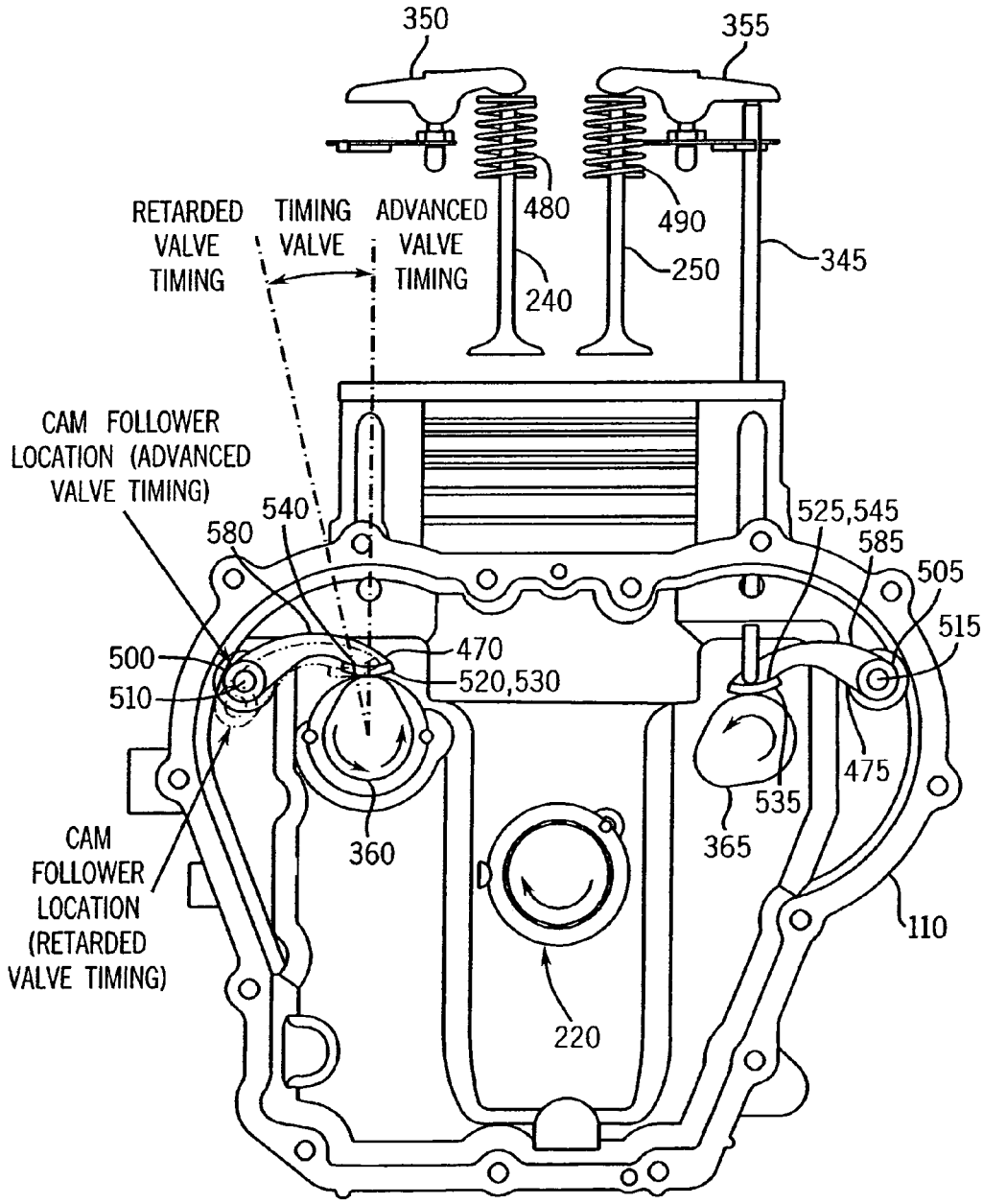
FIG. 9 is an additional top view of the single cylinder engine of FIG. 1 in which cam follower arms of the engine are particularly evident.

Referring to FIG. 9, certain components of the valve train 460, particularly the cams 360,365, one of the push rods 345 and both of the cam follower arms 470,475, are shown in further detail as implemented with respect to the crankcase 110. In particular, FIG. 9 shows the two cam follower arms 470,475 to have respective main arm portions 580,585 that are attached to the crankcase 110 by way of respective bolts 500,505 or other fastening devices at respective pivot points 510,515 so that the cam follower arms can rotate about the pivot points. At the other ends of the main arm portions 580,585, the respective cam follower arms 470,475 have respective shoes 520,525 that rest upon the respective cams 360,365. Bottom surfaces 530,535 of the respective shoes 520,525, which rest upon the respective cams 360,365, are convex. The respective push rods 340,345 rest upon respective top surfaces 540,545 of the respective shoes 520,525.

As shown, the top surfaces 540,545 are concave such that the push rods 340,345 remain in contact with the shoes 520,525 despite movements of the cam follower arms 470, 475. Depending upon the embodiment, the tips of the push rods 340,345 also can be held in place relative to the shoes 520,525 either by way of dimples/holes in the shoes or by way of drilled guiding passage in the crankcase 110 (not shown). In at least some embodiments, the push rods 340, 345 are guided to experience linear movement. The cam follower arms 470,475 can be made from a variety of materials, but in the present embodiment are stamped from sheet metal or made from powdered metal, to reduce manufacturing costs. In the present embodiment, the main arm portions 580,585 of the cam follower arms 470,475 have narrow cross sections as measured along the axes of their respective bolts 500,505 at the respective pivot points 510, 515, and the shoes 520,525 constitute flanges extending substantially perpendicularly off of the main arm portions 580,585. However, in alternate embodiments, the cam follower arms 470,475 could take on any of a number of other shapes. For example, the main arm portions could have a thickness that is substantially equal to the width of the shoes 520,525.

Referring still to FIG. 9, only the push rod 345 is shown while the other push rod 340 is absent from view, in order to more clearly reveal different possible configurations of the cam follower arm 470. As shown, depending upon the embodiment, the pivot point 510 at which the cam follower arm 470 is attached to the crankcase 110 by the bolt 500 (or other attachment device) can be at different locations around the cam 360. Although not shown, the other cam follower arm 475 can also be varied in its positioning with respect to its respective cam 365, by varying the pivot point 515. Because the shoes 520,525 of the cam follower arms 470, 475 are fairly long and have the concave top surfaces 540,545, the push rods 340,345 continue to rest upon the shoes even though the positioning of the cam follower arms is varied within a fairly significant range of positions.

By varying the positioning of either of the cam follower arms 470,475, it is possible to vary the timing of the movements of the respective cam follower arms with respect to their respective cams 360,365 and thus with respect to the crankshaft 220 driving those cams. Such variations in the timings of the movements of the respective cam follower arms 470,475 additionally produce corresponding variations in the timings of the movements of the respective push rods 340,345, rocker arms 350,355 and valves 240,250. Consequently, the timing of the valves 240,250 can be varied with respect to their corresponding cams 360,365 and the crankshaft 220. Insofar as the respective cams 360,365 both rotate in response to the rotation of the same crankshaft 220, variation in the positioning of one or both of the cam follower arms 470,475 also allows for variation in the timing of the valves 240,250 relative to one another.

FIG. 9 in particular shows the cam follower arm 470 in first and second positions, with the first position being shown with solid lines and the second position being shown in phantom. In the embodiment of FIG. 9, the cam 360 rotates counterclockwise during operation of the engine 100. Also, the second position of the cam follower arm 470 is farther counterclockwise relative to the cam 360 than the first position of the cam follower arm 470, such that the bottom surface 530 of the shoe 520 of the cam follower arm in its first position interfaces the cam 360 at a somewhat more counterclockwise location than when the cam follower arm is in its second position. Consequently, the cam follower arm 470 when in its first position provides advanced valve timing relative to when the cam follower is in its second position.

Variation of the positioning of the cam follower arms 470,475 is not the only manner in which the timing of the valves 240,245 can be varied in relation to the crankshaft 220 and to one another. The valve timing can also be varied simply by varying the relative angular orientations of the cams 360,365. However, variation of the angular orientations of the cams 360,365 is in practice limited to a discrete number of settings that correspond to the different teeth (not shown) on the gears 320,325 that interface the crankshaft 220. That is, assuming a particular rotational position of the crankshaft 220, each of the cams 360,365 can only take on a certain number of rotational positions relative to the crankshaft and to one another, by varying which of the teeth of the gears 320,325 interface the crankshaft 220 at that particular rotational position.

Such variation in the angular orientations of the cams 360,365 relative to the crankshaft 220 essentially allows for large changes in the timing of the cam follower arms 470,475 and corresponding large changes in the timing of the valves 240,250, both in relation to the crankshaft 220 and in relation to one another. Consequently, assuming that each tooth of the gears 320,325 occupies a certain sector on the gears and thus defines a particular angle of variation (e.g., 6 degrees), it is not necessary in practice to vary the positioning of the respective cam follower arms 470,475 in amounts greater than that particular angle, since such large variations are easily obtained simply by reorientating the gears in relation to the crankshaft. Rather, variation in the positioning of the respective cam follower arms 470 is typically employed to allow for "fine-tuning" of the valve timing (e.g., 2 degrees) once the positioning of the cams 360,365 with respect to the crankshaft 220 has been set. By a combination of varying the positioning of the cam follower arms 470,475 on the crankcase 110 to obtain fine adjustments in valve timing, and varying the relative positioning of the cams 360,365 with respect to the crankshaft 220 to obtain gross adjustments in valve timing, any desired valve timing setting can be achieved.

In the embodiment shown in FIG. 9, the cam follower arms 470,475 are rotatably attached at the respective pivot points 510,515 by way of the respective bolts 500,505, which fit through corresponding holes in the crankcase 110. The cam follower arms 470,475 can only be moved to different positions if other holes have been drilled (or otherwise provided) into the crankcase 110 to receive the bolts 500,505 at other locations. Thus, in certain embodiments, the crankcase 110 has multiple holes for receiving each of the bolts 500,505 at multiple specific locations. However, in alternate embodiments, the holes for receiving the bolts 500,505 take the shape of curved slots having a width that is approximately the same as the thickness of the bolts 500,505, but which is less than the diameter of the heads on the bolts. In such embodiments, the bolts 500,505 can be positioned at any positions along the length of the slots, such that the cam follower arms 470,475 can take on any position within a range of positions.

In these embodiments, in which the bolts 500,505 or other attachment devices are employed to attach the cam follower arms 470,475 at specific pivot points such as the pivot points 510,515 on the crankcase 110 or other component supported by the crankcase, the positioning of the cam follower arms 470,475 is typically set during manufacture of the engine. However, in alternate embodiments, it may be desirable to be able to vary the valve timing of the engine during operation of the engine or at other times in order to modify various operational characteristics of the engine, or to tailor the engine for operation under specific operational conditions. The present invention is intended to encompass such alternate embodiments in which the positioning of the cam follower arms 470,475 can be modified after manufacture of the engine.

In some of these embodiments, such changes to the positioning of the cam follower arms 470 would have to be manually performed by a technician or other person. For example, a technician could loosen the bolts 500,505, move the cam follower arms 470,475 to different positions (e.g., different positions within the curved slots discussed above), and then retighten the bolts. However, in certain other alternate embodiments, it would be desirable if the cam follower arms 470 could be moved mechanically and even automatically, during engine operation. This repositioning of the cam follower arms 470,475 could be effected by attaching the cam follower arms not directly to the crankcase 110, but rather to an adjustable positioning device that in turn was coupled to the crankcase. Such an adjustable positioning device could allow an operator, a mechanical component within the engine, or an engine controller to vary the positioning of the cam follower arms 470,475, and thereby adjust valve timing and engine performance. In one such embodiment, the adjustable positioning device would operate in response to (or include) a centrifugal governor.

The engine 100 is shown to be a single cylinder engine having only a single intake valve 240 and a single exhaust valve 250, and only two sets of cam follower arms 470,475, push rods 340,345 and rocker arms 350,355. Nevertheless, in alternate embodiments, it is possible for the above-discussed cam follower arms to be implemented in engines having different configurations that can involve multiple cylinders, only one or more than two cams, and only one or more than two valves. That is, cam follower arms of the type discussed above are applicable to all types of engines that impart movement to valves by way of push rods that interface cams.

While the foregoing specification illustrates and describes the preferred embodiments of this invention, it is to be understood that the invention is not limited to the precise construction herein disclosed. The invention can be embodied in other specific forms without departing from the spirit or essential attributes of the invention. Accordingly, reference should be made to the following claims, rather than to the foregoing specification, as indicating the scope of the invention.

What is claimed is:

1. An internal combustion engine comprising:

a crankcase including a cylinder;

a first valve;

a first push rod;

a first rocker arm supported by the crankcase and coupling the first valve to the first push rod;

a first cam rotatably supported by the crankcase; and a first cam follower arm having first and second ends and, at an end region proximate the second end, having bottom and top surfaces, wherein the first cam follower arm is rotatably supported by the crankcase about a first pivot point proximate the first end, wherein the bottom surface slidingly interfaces the first cam, and wherein the top surface interfaces the first push rod, whereby interaction of the first cam follower arm with both the first cam and the first push rod only occurs at the end region of the first cam follower arm and not within an intermediate region between the first end and the end region of the first cam follower arm.

2. The internal combustion engine of claim 1, wherein the first cam follower arm includes a shoe proximate the second end, wherein the shoe includes the bottom surface and the top surface.

3. The internal combustion engine of claim 2, wherein the bottom surface of the shoe has a substantially convex shape, and the top surface of the shoe has a substantially concave shape.

4. The internal combustion engine of claim 3, wherein the top surface of the shoe includes a dimple for receiving the first push rod.

5. The internal combustion engine of claim 3, wherein the first push rod is guided to experience linear movement by a retaining hole drilled within the crankcase so that the first push rod remains in contact with the shoe.

6. The internal combustion engine of claim 3, wherein the first cam follower arm is manufactured from sheet metal and includes an arm portion extending from the first end to the second end, and wherein the shoe is coupled to and substantially perpendicular to the arm portion.

7. The internal combustion engine of claim 1, wherein the first cam follower arm is rotatably supported about the first pivot point by way of a first bolt that extends from the first cam follower arm into a first hole in the crankcase.

8. The internal combustion engine of claim 7, wherein the crankcase includes a second hole, wherein the first cam follower arm can be repositioned so that the first cam follower arm is rotatably supported about a second pivot point by way of the first bolt extending through the second hole.

9. The internal combustion engine of claim 7, wherein the first hole is a curved slot, and wherein the first bolt can be repositioned along the curved slot so that the cam follower arm is rotatably supported by the crankcase at a plurality of different pivot points.

10. The internal combustion engine of claim 1, wherein the first cam follower arm can be repositioned on the crankcase so that the first cam follower arm is rotatably supported proximate the first end about at least one additional pivot point.

11. The internal combustion engine of claim 10, wherein the repositioning of the first cam follower arm results in a change in timing of the operation of the first valve.

12. The internal combustion engine of claim 10, wherein the first cam follower arm is repositioned by way of one of a manual operation and a mechanical operation.

13. The internal combustion engine of claim 12, wherein the first cam follower arm is repositioned by way of the mechanical operation, and wherein the first cam follower arm is repositioned in response the operation of a centrifugal governor supported by the engine.

14. The internal combustion engine of claim 1, further comprising a crankshaft interfacing a first gear that is coupled to the first cam, wherein rotation of the crankshaft causes the first gear and consequently the first cam to rotate, and wherein a timing of the operation of the first valve can be modified by adjusting the relative rotational positioning of the first gear with respect to the crankshaft, and further modified by adjusting the positioning of the first cam follower arm.

15. The internal combustion engine of claim 1, further comprising a second valve;

a second push rod;

a second rocker arm supported by the crankcase and coupling the second valve to the second push rod;

a second cam rotatably supported by the crankcase; and a second cam follower arm having third and fourth ends and, proximate the fourth end, having lower and upper surfaces, wherein the second cam follower arm is rotatably supported by the crankcase about a second pivot point proximate the third end, wherein the lower surface proximate the fourth end interfaces the second cam, and wherein the upper surface proximate the fourth end interfaces the second push rod.

16. An engine comprising:

a cam;

a cam follower arm in contact with the cam, wherein the cam follower arm includes a first end and the cam follower arm is configured to pivot around a pivot point proximate the first end, and the cam follower arm further includes a second end and the cam follower arm is configured to interface a cam proximate the second end;

a valve, a rocker arm and a push rod, the rocker arm and the push rod linking the valve to the cam follower arm;

a crankcase having an elongated slot; and a coupling element that rotatably couples the cam follower arm to the crankcase, wherein the coupling element extends through the elongated slot and is capable of being moved to a variety of locations within the elongated slot such that the pivot point moves with respect to the crankcase and moving of the coupling element provides for fine adjustments in valve timing, and gross adjustments in the valve timing can be achieved by varying a rotational position of a first gear associated with the cam in relation to an additional gear that drives the first gear;

whereby the cam follower arm can be adjusted in its position relative to the crankcase so as to vary the interaction of the cam follower arm with the cam.

17. The engine of claim 16, wherein the engine further includes a mechanism that automatically moves the coupling element to different ones of the locations during engine operation.

* * * * *